US006688496B1

(12) United States Patent
Ahlmer et al.

(10) Patent No.: US 6,688,496 B1
(45) Date of Patent: Feb. 10, 2004

(54) DOSING DEVICE FOR BULK MATERIALS

(75) Inventors: Peter Ahlmer, Darmstadt (DE); Harald Heinrici, Biebesheim (DE)

(73) Assignee: Schenck Process GmbH, Darmstadt (DE)

( * ) Notice: Subject to any disclaimer, the term of this patent is extended or adjusted under 35 U.S.C. 154(b) by 56 days.

(21) Appl. No.: 10/089,410

(22) PCT Filed: Sep. 27, 2000

(86) PCT No.: PCT/EP00/09448

§ 371 (c)(1),
(2), (4) Date: Mar. 28, 2002

(87) PCT Pub. No.: WO01/25119

PCT Pub. Date: Apr. 12, 2001

(30) Foreign Application Priority Data

Oct. 1, 1999 (DE) ..... 199 47 516

(51) Int. Cl.[7] ..... G01F 13/00
(52) U.S. Cl. ..... 222/153.09; 222/227; 222/236
(58) Field of Search ..... 222/153.09, 227, 222/236, 239, 333, 413

(56) References Cited

U.S. PATENT DOCUMENTS

| | | | | |
|---|---|---|---|---|
| 4,363,428 A | * | 12/1982 | Kruger | 222/227 |
| 5,265,763 A | | 11/1993 | Heinrici et al. | |
| 5,348,195 A | * | 9/1994 | Pajot | 222/227 |
| 5,960,990 A | * | 10/1999 | Radosevich | 222/1 |
| 6,123,486 A | | 9/2000 | Wilms et al. | |
| 6,568,567 B2 | * | 5/2003 | McKenzie et al. | 222/181.1 |

FOREIGN PATENT DOCUMENTS

| | | |
|---|---|---|
| DE | 1813978 | 6/1960 |
| DE | 1104434 | 4/1961 |
| DE | 1281947 | 10/1968 |
| DE | 2425532 | 12/1975 |
| DE | G8316568 | 11/1983 |
| DE | 19501179 | 7/1996 |
| EP | 0486424 | 5/1992 |
| FR | 2696161 | 4/1994 |
| GB | 913671 | 12/1962 |

OTHER PUBLICATIONS

A Company brochure entitled "Multifeed 2001", No. F9106, published Jun. 1991, by the Firm Carl Schenck AG of Darmstadt, Federal Republic of Germany.

* cited by examiner

*Primary Examiner*—Gene Mancene
*Assistant Examiner*—Patrick Buechner
(74) *Attorney, Agent, or Firm*—W. F. Fasse; W. G. Fasse

(57) ABSTRACT

The invention relates to a dosing device containing a supply container (8), a dosing container (30) and a discharge device (12). A separate vertical stirring section (22, 22A) is provided in each container, namely the supply container (8) and the dosing container (30). The vertical stirring section 22A located in the supply container (8) is provided with a drive unit (1) which is also used to drive the lower stirrring section (22) of the dosing container (30). The dosing container (30) can be removed horizontally, sideways. The two stirring sections (22) and (22A) have coupling elements (16, 25) with which they are detachably or releasably interconnected. A coupling arm (25) is provided to this purpose with driving pins (16) which engage in the rotating area of the driven upper stirring section (22A) so that the two stirring sections can be coupled and one stirring section can drive the other stirring section.

10 Claims, 2 Drawing Sheets

DOSING DEVICE FOR BULK MATERIALS

FIELD OF THE INVENTION

The invention relates to a dosing device for bulk materials, particularly hard to flow and sticking bulk materials that tend to form bridges in a supply container.

BACKGROUND INFORMATION

Dosing devices are used in industrial or commercial application processes in which predetermined quantities of bulk materials are, per unit of time, discharged, or are added, or are weighed. Thereby, the bulk materials are withdrawn from a supply container with the aid of discharge devices or conveyor devices and supplied to the scheduled processes.

The conveyor devices are arranged, as a rule, below the supply container so that the bulk materials mostly reach the conveyor device under the influence of gravity. Thereby, problems may occur during the continuous feeding from the supply container into the conveyor, particularly in connection with bulk materials that hardly flow, stick together and form bridges. Therefore, it is frequently necessary that the dosing devices are equipped with stirring mechanisms in the supply containers. During maintenance work or when a change is made from one bulk material to another, the dosing devices should be cleaned. Therefore, the discharge area of the dosing container must be accessible without any large assembly effort.

European Patent Publication EP 0,486,424 discloses a dosing apparatus for supplying bulk materials, constructed of different structural units. The bulk material supply container forms a structural unit with a horizontal stirring device and with a discharge mechanism. A further structural unit is formed by the drives and the weighing section. The first mentioned structural unit can be separated from the second structural unit without a large mounting effort, whereupon the unit can be cleaned quickly and without a prolonged down time. This operation is possible only for smaller dosing devices because it is always necessary to remove the entire bulk material container with the entire stirring mechanism and with the discharge device for the cleaning operation. Such smaller dosing devices are not required for statical reasons to be installed in a fixed machine frame.

German Patent Publication DE 195 01 179 discloses a dosing device for bulk materials in which a separate intermediate container is arranged above a discharge mechanism. The intermediate container comprises a vertical stirring mechanism and can be released from its drive and from the discharge mechanism by a vertical plug-in connection. However, there is no connection between the stirring mechanism and a supply container attachable above, so that it is possible that the bulk material sticks to the supply container, or a separate stirring mechanism must be arranged there.

A company brochure entitled "Multifeed 2001", No. F9106, published June 1991, by the Firm Carl Schenck AG of Darmstadt, discloses a dosing device for bulk materials, which device forms part of a differential dosing scale. This differential dosing scale is constructed in a modular manner and is equipped with laterally tiltable structural units below a supply container installed in a fixed position. Such a structure provides a better accessibility during service or cleaning operations. One construction variant suitable for hardly flowing bulk materials is disclosed in which a vertical stirring mechanism is arranged in the rigidly mounted supply container. The vertical stirring mechanism extends all the way to the bottom of an intermediate container which is removably secured below the supply container. If service and cleaning operations must be done, it becomes necessary to release a discharge mechanism which is arranged under the intermediate container. The discharge mechanism is then tiltable laterally below the intermediate container. Only then it is possible to take off the intermediate container with the aid of a clamping strap. However, the intermediate container can be taken off only in the downward direction because of the vertical stirring section inside thereof. For this purpose a vertical disassembly space must be provided which requires a height corresponding approximately to the height of the intermediate container. Detaching of this type of construction is relatively labor intensive when service or cleaning operations must be done. Additionally, it requires a vertical structural space that is not insignificant.

Another construction variant of the differential dosing scale has but one horizontal stirring device in the intermediate container instead of a vertical stirring device in the supply container and in the intermediate container. The horizontal stirring device has its own drive. However, hardly flowable bulk materials can adhere or form bridges in the supply container, whereby a uniform dosing is impaired. Particularly, it is frequently not possible with such horizontal stirring mechanisms when dosing strongly adhering powders, to separate these all over from the margin and bottom areas because the stirring components cannot reach these areas. Bulk materials such as groceries remaining in these areas can easily over-age during prolonged dosing durations or they may harden or they may impair the dosing operation in another manner so that intermediate service or cleaning operations are necessary.

OBJECT OF THE INVENTION

In view of the above it is the object of the invention to provide a dosing device that is easily accessible and that assures a uniform throughflow of all bulk materials through the bulk material containers with most simple structural components.

SUMMARY OF THE INVENTION

This object is achieved by the invention with a bulk material dosing device comprising a multi-part bulk material container, a stirring mechanism rotatably mounted in said multi-part bulk material container, a drive for rotating said stirring mechanism, said multi-part bulk material container comprising at least a supply container part and a removable dosing container part, said stirring mechanism comprising a plurality of stirring sections, wherein at least one stirring section is rotatably positioned in said dosing container part and another separate stirring section is rotatably positioned in said supply container part, and a releasable coupling operatively connecting said plurality of stirring sections to each other in a force transmitting manner for driving said stirring mechanism, and releasable means for laterally removing said dosing container part together with its stirring section.

The invention has the advantage that by using a vertical stirring mechanism, the marginal areas and the bottom areas of the bulk material container having a rotational symmetry all the way to the outlet opening are reachable by stirring mechanism wings. Thus, no bulk material remainders can adhere or spoil. Simultaneously, a homogeneous bulk material throughflow is achievable because the uniform rotational motion of the wings of the stirring device across the direction of the force of gravity reaches all container areas in the same force direction, whereby the flow velocity is uniformly influenced in all areas.

The invention has further the advantage that due to the stirring device coupling the fixed installed stirring device areas and container areas do not need to be disassembled with the aid of tools when cleaning or service operations are necessary so that prolonged down times of the dosing device are avoidable. At the same time the discharge device with a portion of the bulk material container is horizontally laterally removable due to the stirring device coupling. As a result, advantageously no additional vertical assembly space is required for dosing components mounted in the direction of the gravity force. Furthermore, the stirring coupling permits driving both stirring sections through the force transmitting coupling with but one stirring drive so that, advantageously, a separate stirring device drive for the removable stirring device section and container part is obviated.

According to a special embodiment of the invention the discharge apparatus is horizontally slidable into a discharge head that is mounted in a fixed position. This feature advantageously permits separating structural components which require service or cleaning, in a simple manner from the side of the dosing device that faces away from the process. Such separating is achievable without any substantial assembly effort and expense.

BRIEF DESCRIPTION OF THE DRAWINGS

The invention will be described in more detail with reference to an example embodiment that is shown in the drawings, wherein.

DETAILED DESCRIPTION OF A PREFERRED EXAMPLE EMBODIMENT AND OF THE BEST MODE OF THE INVENTION

Figure 1:
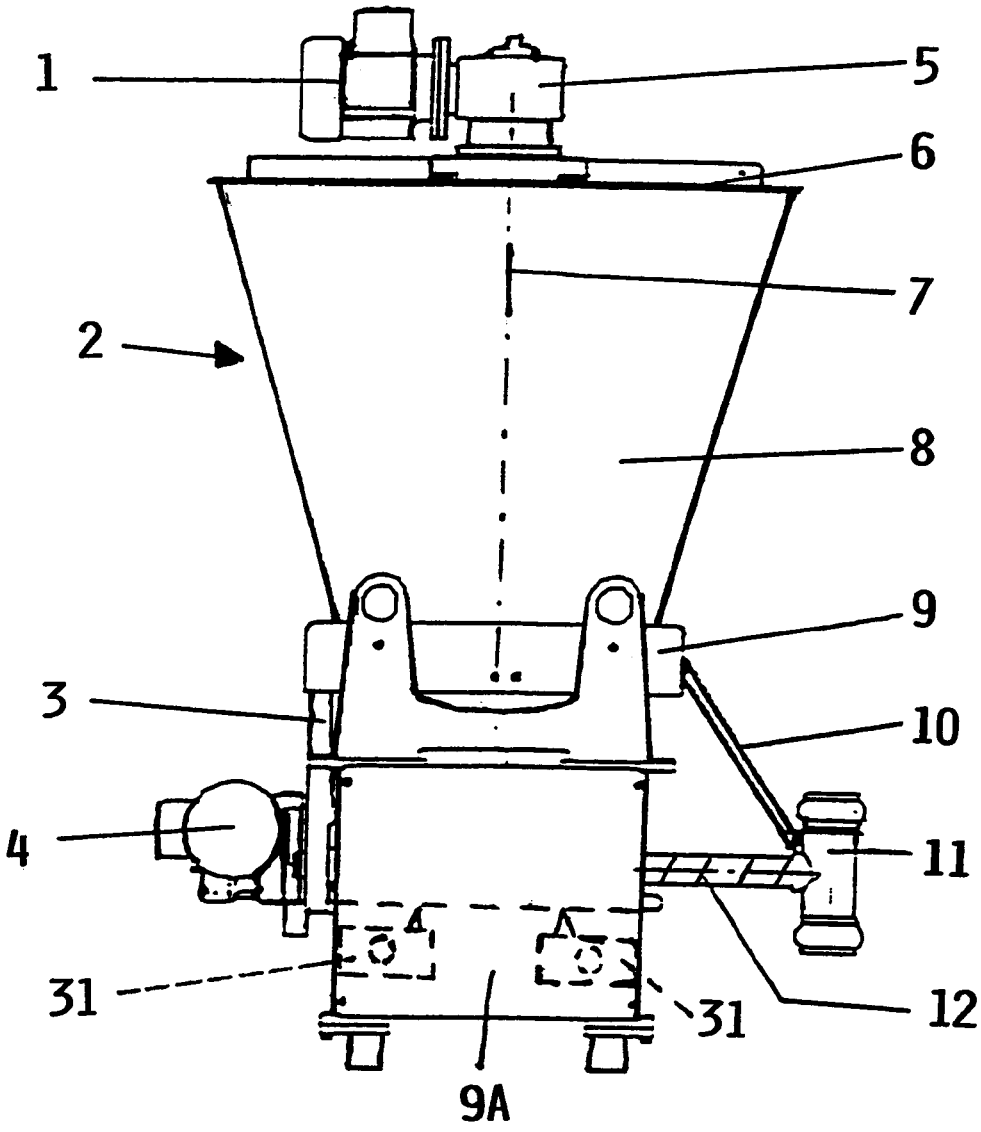
FIG. 1 is a side view of a dosing device for bulk materials.

FIG. 1 of the drawings shows a bulk material dosing device 2 having at least two separate container sections or parts including an upper container part 8 and a lower container part 30 for containing bulk material. Further, the dosing device 2 includes a vertical stirring mechanism with a stirring drive 1, and a discharge device 12. The vertical stirring mechanism includes a first vertical stirring section 22 rotatably mounted in the lower container part 30 which is removable laterally in a horizontal direction. The vertical stirring mechanism further includes a second vertical stirring section 22A rotatable mounted in the upper container part 8. The two stirring sections 22 and 22A are coupled to each other in a force-transmitting but releasable manner and the lower stirring section 22 is removable relative to the upper stirring section 22A as will be described in more detail below.

The upper part 8 of the bulk material container is constructed as a supply container 8 which, particularly in connection with differential dosing scales, holds a predetermined supply of bulk material between replenishing phases. The upper supply container 8 is mounted in a machine frame 9 of the dosing device 2 in a fixed position and generally can be dismounted only with the aid of screw connections.

The lower container part 30 is constructed as a dosing container 30 which is mounted below the supply container 8. The lower dosing container part 30 is removably connected to the supply container 8 by a clamping device such as a clamping strap 17A closable by a releasable lock 17. The above mentioned vertical stirring mechanism having two sections 22 and 22A is provided in the container 8 and in the dosing container 30 dosing of hardly flowing bulk materials or bulk material that tends to form bridges. The two component vertical stirring devices rotates about a vertical rotation axis 7 inside the two containers 8 and 30. Both sections 22 and 22A of the vertical stirring device are driven by the stirring drive in the form of an electrical motor 1 which is mounted above the supply container 8 and connected thereto by a screw connection. An angular gear drive 5 is arranged next to the electric motor 1 for reducing the r.p.m. for driving the stirring device with a relatively small r.p.m. of about ten revolutions per minute (r.p.m.). The vertical stirring mechanism in the supply container 8 can be removed only by dismounting the electric motor 1, the angular gear drive 5 and a cover 6 of the supply container 8 for moving the vertical stirring device upwardly out of the supply container 8.

The lower dosing container 30 is positioned below the supply container 8 and has a conical shape just as the supply container 8. The lower dosing container 30 is closed at its bottom by a horizontal cover sheet metal 29. A slot-shaped outlet opening is provided in the bottom sheet metal 29. The discharge device 12 is arranged under the outlet opening. The discharge device is constructed as a screw conveyor 12 which is secured horizontally to the bottom of the dosing container 30. The screw conveyor 12 comprises one or several dosing screws which are surrounded by one or two tubular walls and which are driven by a separate electric motor 4. The discharge opening of the screw conveyor 12 merges into a discharge head 11 laterally next to the dosing container 30. The discharge head 11 is constructed as a T-shaped pipe section and mounted by a securing strut 10 to the machine housing 9 of the dosing device. The discharge pipe of the screw conveyor 12 is inserted into the horizontal opening of the discharge head 11 and sealed by means of an elastic sealing providing an air-tight and dust-tight connection.

The drive motor 4 of the screw conveyor 12 is rigidly connected to the machine housing 9 of the dosing device by a vertical tilting arm 3. Thereby it is possible to decouple the drive motor 4 from the dosing conveyor screw through a special coupling by a tilting motion. For cleaning or service operations it is then possible to remove the dosing container 30 laterally below the supply container 8. For this purpose only the clamping lock 17 of the clamping strap 17A is to be released and the lower dosing container 30 can then be pulled out laterally independently of the discharge head 11. Since the discharge head 11 is normally connected with a pipe system not shown through which the bulk materials are transported to a processing station, the cleaning and service operations are advantageously performable on the side of the dosing device facing away from the processing station without the need for an expensive disassembly of the bulk material transporting connections to the processing station.

Figure 2:
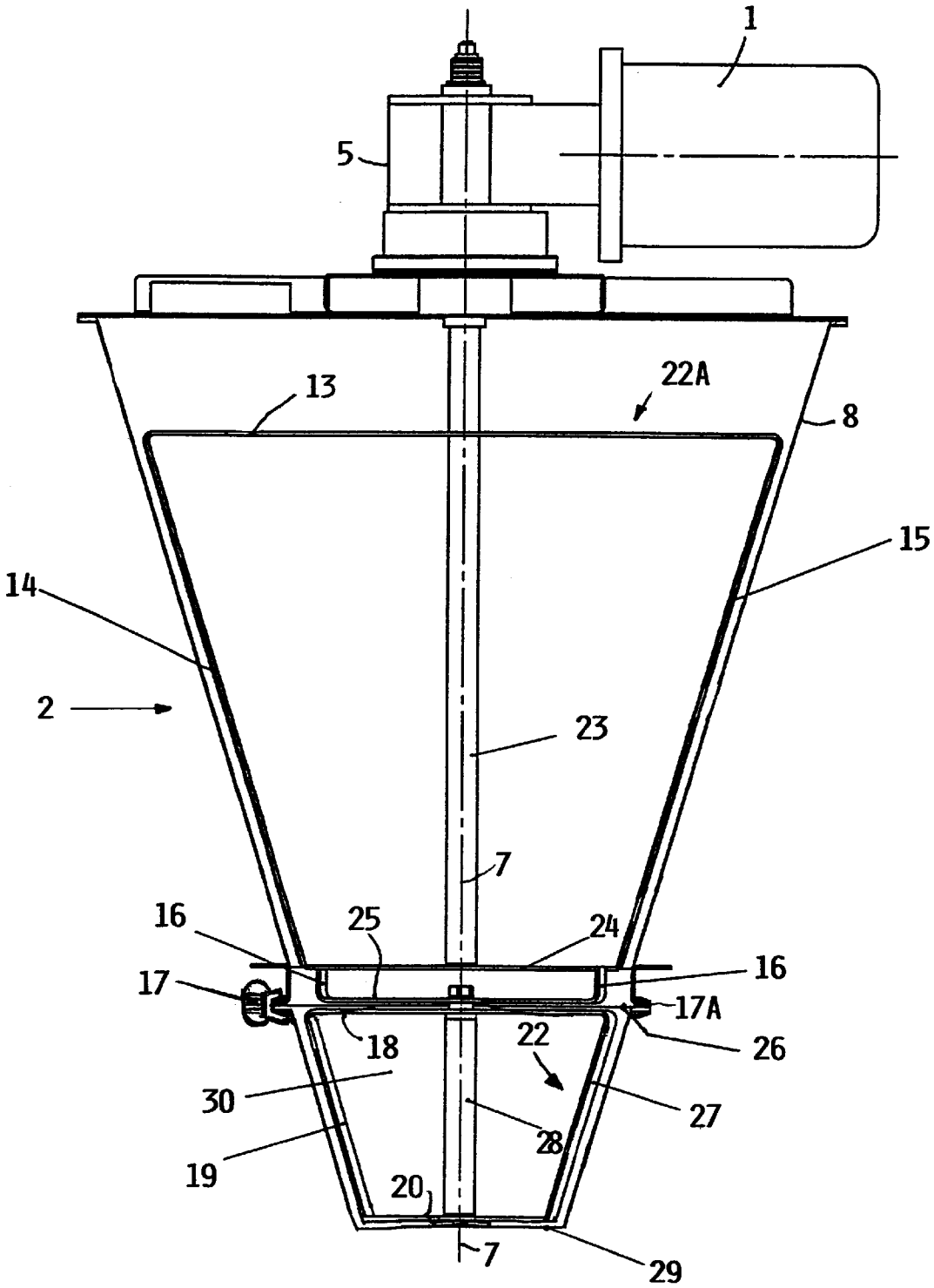
FIG. 2 is a sectional view through a multi-part bulk material container.

FIG. 2 of the drawing shows a sectional view of the supply container 8 and the dosing container 30 with the two sections 22 and 22A of the vertical stirring mechanism. The upper supply container part 8 is arranged above the lower dosing container part 30 and tapers conically in the downward direction. The mechanically separate stirring section 22A is mounted in the upper container part 8 and is driven through a vertical central shaft 23 connected to the drive motor 1 through the gear 5. The vertical central shaft 23 is arranged perpendicularly, however it can be arranged at an angle for inclined conveyors or other embodiments. The stirring section 22A of the supply container part 8 comprises for example two stirring wings 14 and 15 which are rigidly secured to the vertical central shaft 23 by two horizontal arms 13 and 24 so that the stirring wings 14 and 15 are positioned close to and in parallel to the conical inner surface of the upper supply container part 8. The horizontal arm 13 is arranged in the area of the upper container cover 6 and the further horizontal arm 24 is arranged close to the lower end of the supply container part 8.

The vertical central shaft 23 extends through the supply container 8 from the angular gear drive 5 all the way to the lower end of the supply container 8. The central shaft 23 is supported at its upper end at the angular gear drive 5.

An intermediate ring 26 comprises a central section with a bore and an outer ring of the size of the container diameter where the two container parts 8 and 30 are releasably connected to each other. Connecting lands are arranged between the outer ring and the central section. The intermediate ring 26 is arranged between the two container parts 8 and 30 and is fixed in its position by the above mentioned clamping strap 17A with the clamping lock 17. The intermediate ring 26 serves for centering the two stirring sections 22 and 22A relative to each other for facilitating the coupling these sections 22, 22A releasably to each other when the strap 17A and lock 17 interconnect the container parts 8 and 30.

The dosing container 30 arranged below the supply container 8 also has a conical shape tapering downwardly, whereby the upper diameter of the dosing container 30 corresponds to the lower diameter of the supply container 8. The dosing container 30 is open upwardly and closed at its bottom by the above mentioned bottom sheet metal 29 that has an outlet opening. The bulk material flowing through the outlet opening enters into the screw conveyor 12 arranged below the dosing container 30. The screw conveyor 12 feeds the bulk material into the discharge head 11 in a dosed manner in accordance with an r.p.m. controlled in closed loop fashion through the drive motor 1 and gear 5.

The lower stirring section 22 is a separate vertical stirring section rotatably mounted in the dosing container 30, whereby the lower stirring section 22 forms an extension of the upper stirring section 22A in the supply container 8. The lower stirring section 22 has a construction comparable to that of the upper stirring section 22A. The lower stirring section 22 comprises a second central shaft 28 which is arranged in axial alignment with the central shaft 23 of the stirring section 22A in the supply container 8. The second central shaft 28 carries two wings 19 and 27 secured to the shaft 28 by further horizontal arms 18 and 20 positioned at the upper end and at the bottom end of the shaft 28, respectively. These two horizontal arms 18 and 20 are so dimensioned that the two stirring wings 19 and 27 are positioned in the area of the walls of the dosing container 30 preferably in parallel to these container walls. The second central shaft 28 is supported at its lower end by a bearing element which is connected with the bottom sheet metal 29 while the upper end is supported in the above mentioned intermediate ring 26.

A coupling arm 25 is arranged above the intermediate ring 26. The coupling arm 25 is connected in a force-transmitting manner with the second central shaft 28 of the lower stirring section 19. For this purpose a square holder is provided on the central shaft 28 above the intermediate ring 26. The coupling arm 25 is attachable to the square holder with a respective opening. The coupling arm 25 extends over a length which is not larger than the horizontal arms 18 and 24 of the stirring sections 22 and 22A at the connection position of the two container parts 8 and 30. However, the coupling arm is preferably larger than the half diameter of the dosing container 30 in this plane. The coupling arm 25 has both of its ends angled upwardly in a vertical direction, whereby two entraining pins 16 are formed. These entraining pins, in their installed condition, reach into the rotational range of the horizontal arm 24 of the upper rotational stirring section 22A for driving the lower stirring section 22 through the upper stirring section 22A.

During the rotation of the upper rotational stirring section 22A the horizontal arm 24 strikes against the entraining pins 16 thereby entraining the lower stirring wing section 22 and thus form a force-transmitting coupling between the two stirring sections. Due to such a coupling the entraining pins 16 which rotate with the bulk material flow cannot clog up and it is not necessary to specially align these entraining pins when the dosing container 30 is inserted under the supply container 8, whereby the dosing device is easily reassembled without the need for special fittings that would have to be aligned in their rotational direction. Simultaneously, the coupling arm 25 performs an additional stirring action so that the homogeneous throughflow of the bulk material is improved. The coupling arm 25 with its entraining pins 16, however, could also be attached at the upper rotational wing so as to reach with its entraining pin into the rotational zone of the lower stirring section 22. Both stirring sections 22 and 22A rotate about the central rotation axis 7 when these sections are coupled to each other.

FIG. 1 also shows schematically, for example two load cells 31 which support the supply container 8, the dosing container 30 and the discharge mechanism 12. The load cells 31 support these elements opposite a fixed housing or frame member 9, whereby the control of the dosing of the bulk materials takes place by means of the load cells in a gravimetric manner.

What is claimed is:

1. A bulk material dosing device comprising a multi-part bulk material container, a stirring mechanism rotatably mounted in said multi-part bulk material container, a drive for rotating said stirring mechanism, said multi-part bulk material container comprising at least a supply container part and a removable dosing container part, said stirring mechanism comprising a plurality of stirring sections, wherein at least one stirring section is rotatably positioned in said dosing container part and another separate stirring section is rotatably positioned in said supply container part, and a releasable coupling operatively connecting said plurality of stirring sections to each other in a force transmitting manner for driving said stirring mechanism by said drive, and releasable means for laterally removing said dosing container part together with its stirring section.

2. The bulk material dosing device of claim 1, wherein said multi-part bulk material container comprises two container parts including said supply container part mounted in an upper position and said dosing container part removably mounted below said supply container part, wherein one of said separate stirring sections is rotatably mounted in each said two container parts, and wherein said means for laterally removing comprise a clamping device with a releasable lock for coupling said two container parts to each other to permit said lateral removing of said dosing container part with its stirring section.

3. The bulk material dosing device of claim 1, wherein said releasable coupling comprises disengageable coupling elements positioned between said stirring mechanism sections for transmitting a driving force from one stirring section to the other stirring section.

4. The bulk material dosing device of claim 1, wherein said releasable coupling comprises a driving force transmitting coupling arm with at least one entraining pin positioned between said stirring sections for coupling said stirring sections to each other, said entraining pin reaching into a rotation range of one stirring section and being connected to at least one other separate stirring section, whereby said stirring sections are coupled to each other for driving by said drive for rotating.

5. The bulk material dosing device of claim 4, wherein said other separate stirring section in said supply container part comprises two stirring wings, said at least one entraining pin of said coupling arm of said at least one stirring section reaching into said rotation range of at least one stirring wing of said two stirring wings of said other separate stirring section, said coupling arm being connected to said one stirring section for entraining said at least one entraining pin with said at least one stirring wing for rotating of said stirring mechanism.

6. The bulk material dosing device of claim 1, wherein each of said stirring sections comprises a respective central shaft to provide at least two shafts aligned with each other, said dosing device further comprising an intermediate ring positioned at a transition between said at least two central shafts, and wherein at least one of said central shafts is centrically supported by said intermediate ring.

7. The bulk material dosing device of claim 6, wherein said intermediate ring comprises a central bearing element which is connected by at least one land with an outer ring.

8. The bulk material dosing device of claim 1, further comprising a discharge mechanism positioned in an exit area of said removable dosing container part for feeding bulk material to a fixed discharge head positioned at a side facing other process components.

9. The bulk material dosing device of claim 8, wherein said discharge mechanism comprises a screw conveyor having conveying organs arranged horizontally and laterally relative to said fixed discharge head.

10. The bulk material dosing device of claim 1, further comprising a housing and load cells mounted in said housing, said supply container part, said dosing container part, and a discharge mechanism being supported by said load cells in said housing, whereby a control of the dosing of the bulk materials takes place with the aid of said load cells in a gravimetric manner.

* * * * *